United States Patent [19]

Rocca

[11] 4,448,097

[45] May 15, 1984

[54] DRIVER TOOL

[76] Inventor: David Rocca, 4006 Greenacre Rd., Castro Valley, Calif. 94546

[21] Appl. No.: 329,303

[22] Filed: Dec. 10, 1981

[51] Int. Cl.[3] ..... B25B 13/46

[52] U.S. Cl. ..... 81/177 M; 81/439; 81/62

[58] Field of Search ..... 81/439, 177 M, 177 N, 81/177 R, 62, 63, 177 F, 180 R, DIG. 1; 16/110 R; 74/543; 145/61 R, 61 J; 24/3 H, 3 J, 3 L, 11 P

[56] References Cited

U.S. PATENT DOCUMENTS

| | | | |
|---|---|---|---|
| 814,020 | 3/1906 | Clifford | 81/439 X |
| 844,061 | 2/1907 | Van Valkenburg | 24/11 P |
| 1,119,290 | 12/1914 | Lachman | 145/61 R |
| 1,296,416 | 3/1919 | Maddox | 145/61 R |
| 1,747,647 | 2/1930 | Racicot | 145/61 R |
| 2,596,594 | 5/1952 | Petre | 81/439 X |
| 3,061,061 | 10/1962 | Browning . | |
| 3,568,899 | 3/1971 | Rosenberg | 269/95 X |
| 4,086,831 | 5/1978 | Smith | 81/62 |

FOREIGN PATENT DOCUMENTS

| | | | |
|---|---|---|---|
| 718990 | 11/1954 | United Kingdom | 81/439 |

*Primary Examiner*—Frederick R. Schmidt
*Assistant Examiner*—Steven P. Schad
*Attorney, Agent, or Firm*—Harris Zimmerman; Howard Cohen

[57] ABSTRACT

A driver tool utilizing a sleeve which fits within and rotates with an elongated shaft. Driving bits are held to the sleeve and turned by the action of the rotating shaft. A handle which is expandable connects to the elongated shaft.

10 Claims, 14 Drawing Figures

FIG-8
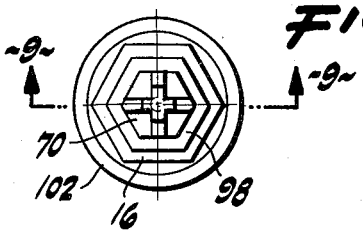
FIG-7
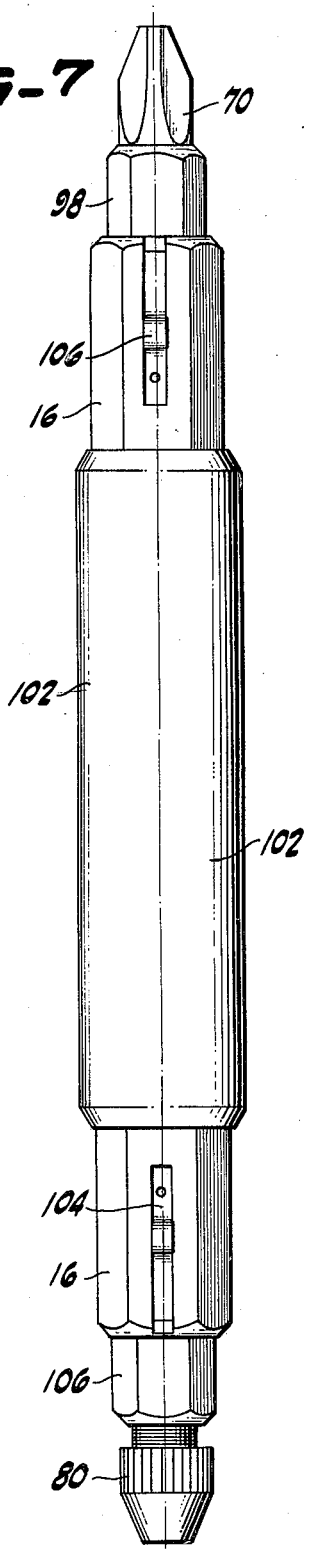
FIG-4
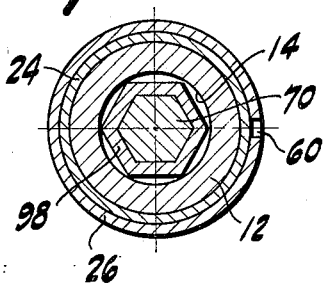
FIG-3
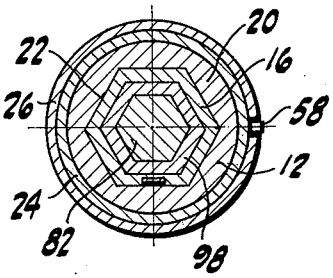
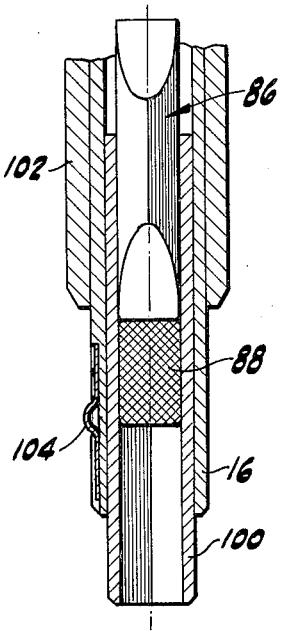
FIG-10
FIG-9
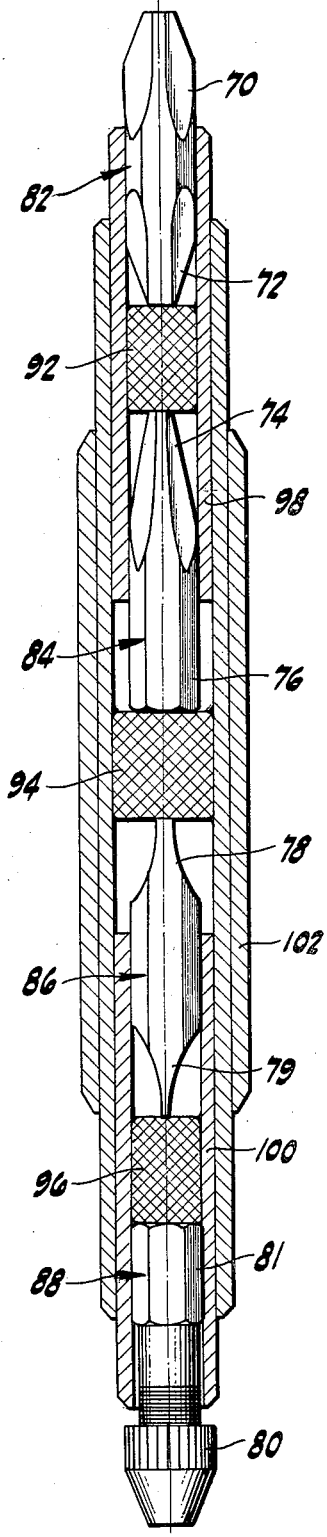

FIG-11
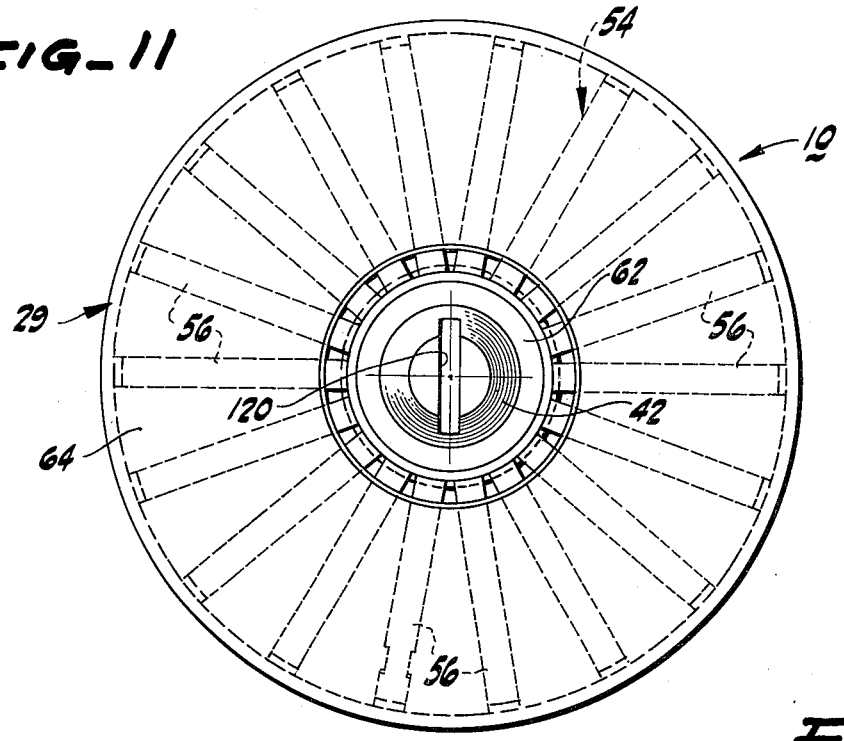
FIG-12
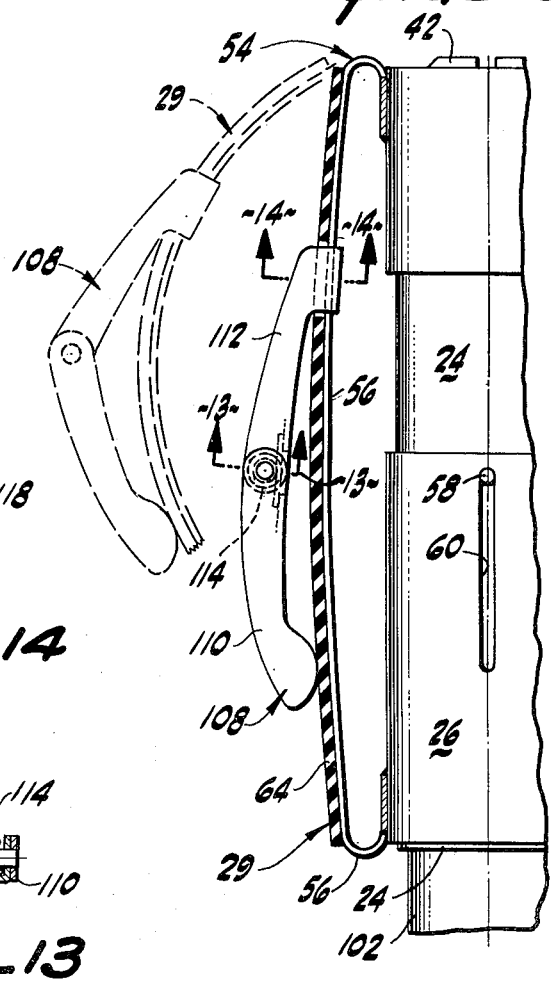
FIG-5
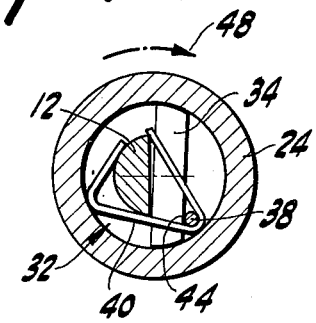
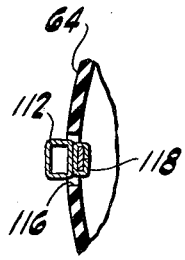
FIG-14
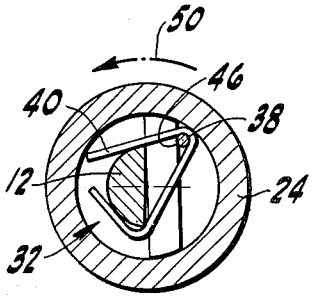
FIG-6
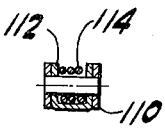
FIG-13

DRIVER TOOL

BACKGROUND OF THE INVENTION

The present invention relates to a novel driving tool which is particularly susceptible to miniaturization.

It is imperative that servicemen, such as locksmiths, electricians, technicians, and the like, carry a complete set of tools to a job site for use in their work. As is often the case, special carrying devices such as holsters, tool boxes, and the like, are necessary to aid in this function. Transporting a large number of tools is a cumbersome task requiring a great deal of effort and time which can be better spent repairing or servicing a particular item.

In the past, tools have been devised to perform a multitude of functions, for example, the tools shown in U.S. Pat. No. 3,742,787. Although this tool is one which includes interchangeable bits, the overall size and performance of the tool makes it difficult to carry in one's pocket or pouch. Likewise, U.S. Pat. No. 3,061,061 describes a ratchet-type screw driver but lacks the interchangeability shown in the former described patent. A compact, versatile tool, which could easily be carried in a shirt pocket, having the performance characteristics of full sized tools, would be a great advantage in the field of maintenance, service, and repair of any conceivable items.

SUMMARY OF THE INVENTION

In accordance with the present invention a novel and useful driver tool having a variety of uses in a compact form is provided.

The driver tool of the present invention utilizes an elongated shaft having an opening which may be a faceted opening. A sleeve removably fits within the faceted opening of the shaft and is rotatable around the axis of elongation of the shaft. Means is provided for holding the sleeve to the elongated shaft such that the sleeve and shaft rotate together.

The invention further embraces at least one driving bit and, preferably, a multiplicity or plurality of driving bits. The driving bits are used in conjunction with means for holding the same to the sleeve. Such means may take the form of a tube which may fit within the sleeve. Each driving bit may be constructed to fit within the tube such that rotation of the elongated shaft rotates the driving bit. Each driving bit may have two tips such as a slotted screw driver head, a Phillips head, an Allen wrench a pin vise, and any other driving bit known in the art. More than one tube may be placed in the sleeve to provide a plurality of choices of bits as desired by the serviceman using the tool.

Magnetic means may be included for confining at least one of the driving bits within a tube. Thus, while one bit of the plurality of bits is being used, the others may be stored within the tool itself.

The driver tool also embraces as part of its structure, a handle. The handle includes means for connecting the same to the elongated shaft. Also, means for expanding a dimension of the handle is provided which increases the size of the handle to provide a better driving grip and provide greater torque. Such expansion may take the form of a plurality of strips fastened at one end to a bushing. The second end portions of the strips would be movable along the bushing. Means may also be included for fixing the second end portions of these strips in relation to the bushing. The bushing would be connected to the elongated shaft by means heretofore described. The handle may be constructed to accomodate an expandable cover thereover. Thus, the cover would increase in size with the expansion of the handle.

Clip means may also be included for permitting attachment of the tool to a pocket, shirt flap, or the like. Such clip means may include a hinged articulated leg which would allow the clip to conform to the outward surface of the expandable handle.

Means for connecting the handle to the elongated shaft may take the form of ratchet means for selectively rotating the elongated shaft in opposite directions about the axis of the shaft. Ratchet mechanisms of the prior art may be applicable to serve this function.

It may be apparent that a novel and useful driver tool that can be easily carried in a workman's pocket, yet perform on par with a full sized screw driver, Allen wrench, or the like.

It is another object of the present invention to provide a driver tool which includes a multiplicity of bits useful in a variety of work situations, stored within the tool.

It is yet another object of the present invention to provide a driver tool which includes a handle which expands its shape to provide a superior grip to the handle in its collapsed form.

It is still another object of the present invention to provide a driver tool which is susceptible to inclusion of a ratchet mechanism known in the art on much larger tools.

The invention possesses other objects and advantages especially as concerns particular characteristics and features thereof, which will become apparent as the specification continues.

BRIEF DESCRIPTION OF THE DRAWINGS

FIG. 3 is a view taken along line 3—3 of FIG. 1.

FIG. 4 is a view taken along line 4—4 of FIG. 1.

FIG. 5 is a view taken along line 5—5 of FIG. 1.

FIG. 6 is a sectional view showing the ratchet mechanism of FIG. 5 in another configuration.

FIG. 7 is a sectional view of the bit holding portion of the present invention shown in situ in FIGS. 1 and 2.

FIG. 8 is a top plan view of FIG. 7.

FIG. 9 is a view taken along line 9—9 of FIG. 8.

FIG. 10 is a broken sectional view of a portion of the bit carrying portion of the present invention.

FIG. 11 is a top plan view of the handle portion of the present invention.

FIG. 12 is a broken enlarged sectional view of the handle portion of the present invention depicting the expansion of the handle in phantom.

FIG. 13 is a view taken along line 13—13 of FIG. 12.

FIG. 14 is a view taken along line 14—14 of FIG. 12.

For a better understanding of the invention, reference is made to the following detailed description.

DESCRIPTION OF THE PREFERRED EMBODIMENTS

Various aspects of the present invention will evolve from the following detailed description of the preferred embodiments thereof, which should be taken in conjunction with the heretofore described drawings.

Figure 1:
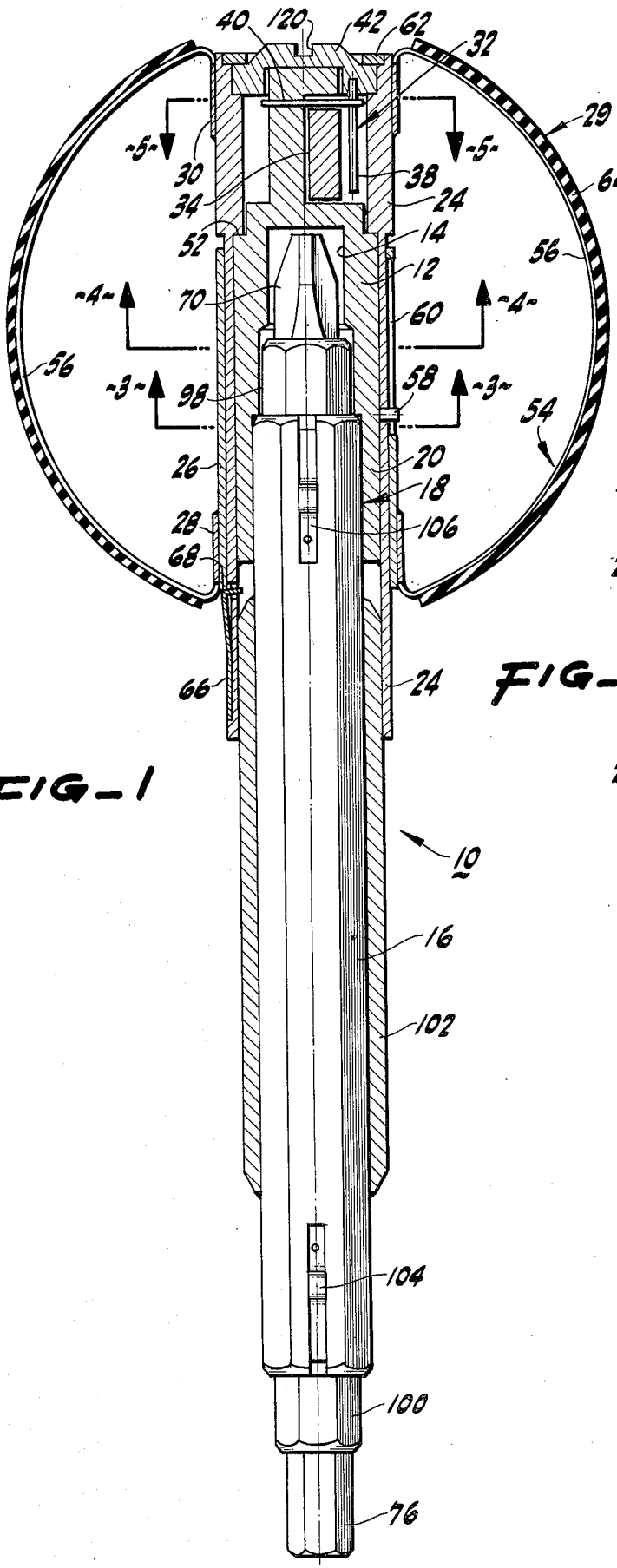
FIG. 1 is a sectional view of the tool with the handle in its expanded position.

The invention as a whole is represented in the drawings by reference character 10. The driver tool 10 includes a shaft 12 having an opening 14 therewithin. A sleeve 16, FIG. 1, removably fits within opening 14 of shaft 12. Means 18 holds sleeve 16 to shaft 12 for rotation of sleeve 16 with any rotation of shaft 12. Means 18 may take the form of providing the lower portion 20 with a faceted cross-sectional configuration, best shown in FIG. 3, which snuggly fits the perimeter 22 of sleeve 16. It is anticipated that frictional forces will hold sleeve 16 to the opening 14 of shaft 12, but detents or spring clips may also be provided (not shown) to perform this function.

Bushings 24 and 26 surround shaft 12. Handle means 29, which will be further described as the specification continues, connects to bushings 24 and 26 at brackets 30 and 28 respectively by fastening means such as gluing, welding, riveting, and the like. Returning to FIG. 1, it may be seen that driver tool 10 includes ratchet means 32 which are illustrated in FIGS. 5 and 6. Ratchet means includes wedge 34 which fits on the inside surface of shaft 12. Pin 38 includes the provision of a clip 40 which presses pin 38 against wedge 34. Cap 42 may be turned with a coin or thumb nail to place pin 38 against wedge 34 at point 44, FIG. 5, or at point 46, FIG. 6. As shown in FIG. 5, ratchet means has been set to turn shaft 12 in a clockwise direction, arrow 48, while in FIG. 6 it will turn shaft 12 in a counterclockwise direction, arrow 50. Reference is made to U.S. Pat. No. 3,061,061 which describes ratchet means 32 in greater detail and no further explanation will be made herein of the same. It should also be noted that bushing 24 contacts shaft 12 at shoulder 52 such that force is exerted along driver tool 10 when handle 29 is pressed downwardly in FIG. 1. Lubrication or the addition of a bearing (not shown) is deemed to be necessary at this point.

Figure 2:
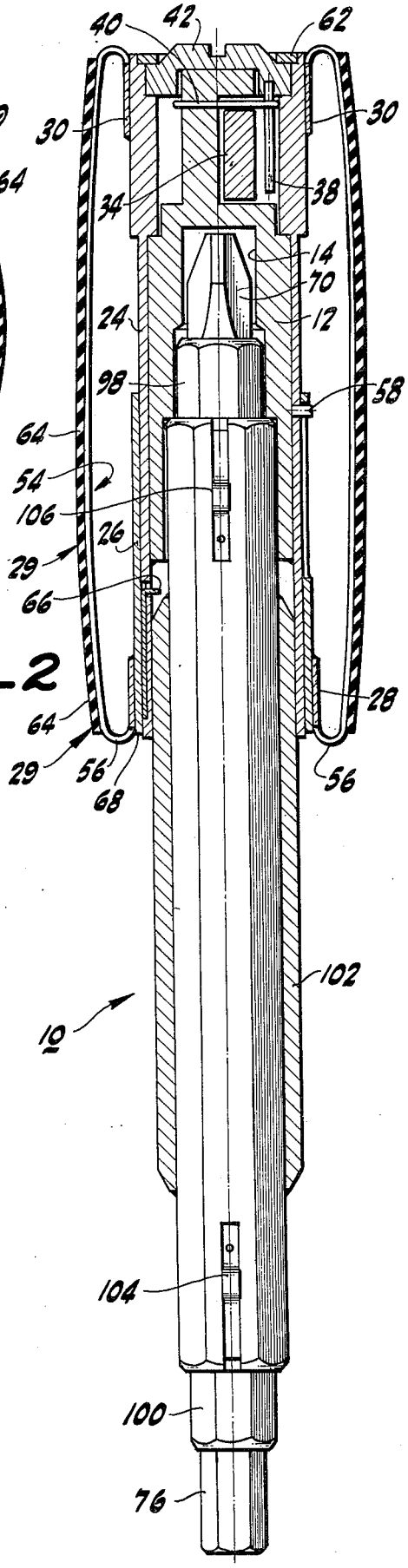
FIG. 2 is a sectional view of the tool with the handle in the collapsed position.

Handle means 29 may be formed to include means 54 for expanding a dimension of handle means 29. As shown in FIGS. 2 and 11, handle means 29 is constructed of a plurality of strips 56 interposed brackets 28 and 30. Bracket 30 is fastened to bushing 24 and bracket 28 is fastened to bushing 26. Bushing 26 slidingly engages the outer surface of bushing 24 such that the strips 56, which are constructed of flexible material, assume a spheroidal configuration, FIG. 1. Pin 58, FIGS. 1–3 and 12, rides in a slot 60 within bushing 26 to prevent rotation of bushing 24 in relation to bushing 26. Ring 62 press fits to hold cap 42 in place. An expandable cover 64 such as an elastomeric material, provides a sure gripping surface to the expanded handle 29 and provides additional torque for the turning of the driver tool 10. Spring 66 fastened to bushing 24, bears on the end surface 68 of bushing 24 to keep handle 29 fully expanded, FIG. 1.

Driver tool 10 encompasses as one of its elements at least one driving bit 70. In the embodiments shown in the drawings, FIG. 9, a plurality of driving bits 70, 72, 74, 76, 78, 79, 80 and 81 are depicted. For example, driving bit 70 is a Phillips head screw driving bit. Also, it should be noted that driving bit 80 is a pin vise. It should be apparent that any known driving bit may be provided for use in the driver tool 10 of the present invention. FIG. 9 again depicts bit units 82, 84, 86, and 88, each having a pair of bits or tips. By way of illustration, bit unit 82 includes driving bits 70 and 72. Magnetic means 92, 94, and 96 confines bit units 82, 84, 86, and 88 within sleeve 16. Magnetic means 94 is fixed to sleeve 16 while magnetic means 92 and 96 are fixed to the inside of tubes 98 and 100. Turning to FIG. 4, it may be seen that the upper portion of opening 14 is circular in cross-sectional configuration but conforms to the hexagonal cross-sectional configuration, FIG. 3, at a place further from cap 42. Hollow member 102 serves to reinforce sleeve 16. Turning to FIG. 10, it may be seen that driver bit units are reversible within tubes 98 and 100. Springs 104 and 106 add to the frictional engagement of sleeve 16 to the inside of shaft 12.

Turning to FIGS. 12 through 14 it may be seen that one of the plurality of strips 56 includes a pocket clip 108 which has an articulated leg 110 which is hingedly attached to another leg 112. Spring 114, FIG. 13, aids in the bending of clip 108 when handle means 29 is in the expanded position. FIG. 12 shows the motion of clip 108 during expansion of handle means 29, in phantom. With respect to FIG. 14 is may be seen that a cutout portion 116 of one of the plurality of strips 56 permits the attachment of clip 108 by the use of tabs 118 crimped about the cutout portion 116. Although the driver tool of the present invention may be of any size, tool 10 may be constructed to be quite small such that it fits in the pocket of the user. For example, the tool may be fifteen centimeters in length having shaft 12 approximately six centimeters in length. Each bit may be exposed about one centimeter from tubes 98 and 100, the overall bit being about two and one-half centimeters in length. The handle 29 could be constructed to be about six centimeters long and one and one-half centimeters in diameter in its collapsed position. When expanded, handle 29 may have a diameter of five and one-half centimeters.

In operation, the user selects the proper bit for use in the particular job at hand. For example, if bit 78 were selected, tube 100 would be pulled from sleeve 16 and reversed such that the end of driving bit 78 extended beyond the lower end of tube 100. The user would then place sleeve 16 within opening 14 of shaft 12. Handle 29 would be expanded utilizing means 54 therefor. Ratchet 32 would be set by turning cap 42 via slot 120 to turn clockwise or counterclockwise. The entire tool then would be ratcheted by gripping handle 29 and twisting the same. The particular driving bit 78 would then drive a screw, bolt, or the like. The driver tool would then be returned to its original collapsed position by pressing spring 66.

While in the foregoing embodiments of the present invention have been set forth in considerable detail for the purposes of making a complete disclosure of the invention, it will be apparent to those of ordinary skill in the art that numerous changes may be made in such details without departing from the spirit and principles of the invention.

What is claimed is:

1. A driver tool, comprising a handle, at least one driving bit, shaft means secured to said handle and adapted to secure said driving bit, and means for expanding a dimension of said handle, including a plurality of strips having like proximal ends joined to a proximal end portion of said handle, bushing means rotatable in common with said shaft means, said bushing means joined to like distal ends of said strips and translatable from a first position in which said strips are compressed longitudinally and expanded outwardly from said handle to a second position in which said strips are relaxed longitudinally and retracted toward said handle, means for releasably retaining said bushing means in said first position, and means for transferring torque from said strips to said bushing means.

2. The driver tool of claim 1, further including clip means joined to said handle for securing said tool to a pocket, including a first leg portion secured to one of said strips, and a second, articulated leg portion hingedly secured to said first portion.

3. The driver tool of claim 1, further including means for connecting said handle to said shaft means, including ratchet means for selectively rotating said shaft means in opposite directions about said axis of said shaft means.

4. The driver tool of claim 1, said shaft means including a shaft having an opening, a sleeve being capable of removably fitting within said shaft opening, means for holding said sleeve to said shaft for rotation in common therewith, a plurality of tubes removably secured in said sleeve in end-to-end relationship for rotation in common therewith, a plurality of driving bits, each secured in removable fashion in one of said plurality of tubes for rotation in common therewith, and means for connecting said handle to said shaft.

5. The driver tool of claim 4 which additionally comprises magnetic means for confining at least one of said plurality of driving bits within at least one of said plurality of tubes.

6. A driver tool, comprising; a shaft having an opening; a sleeve being capable of removably fitting within said shaft opening; means for holding said sleeve to said shaft for rotation thereof with rotation of said shaft; at least one driving bit; means for holding said driving bit to said sleeve; a handle, including means for connecting said handle to said elongated shaft, said handle further including means for expanding a dimension of said handle, including a plurality of strips each having a first end portion and a second end portion, and a bushing surrounding said elongated shaft having a first end portion and a second end portion, said each first end portion of said strips being connected to said first end portion of said bushing, said each second end portion of said strips being movable along said second end portion of said bushing, said means for extending a dimension of said handle further including means for fixing said each second end portion of said strips in relation to said bushing.

7. The driver tool of claim 6 in which said handle includes an expandable cover over said plurality of strips.

8. The driver tool of claim 6 in which one of said plurality of driving bits is a pin vise.

9. The driver tool of claim 6 in which said means for holding said at least one driving bit to said sleeve comprises at least one tube, said at least one driving fitting within said tube for rotation therewith.

10. The driver tool of claim 9 in which said at least one driving bit includes a plurality of driving bits and said at least one tube includes a plurality of tubes in end-to-end disposition in said sleeve.

* * * * *